US010436482B2

(12) United States Patent
Huang et al.

(10) Patent No.: US 10,436,482 B2
(45) Date of Patent: Oct. 8, 2019

(54) ALL-WEATHER SOLAR WATER SOURCE HEAT PUMP AIR CONDITIONING SYSTEM

(71) Applicant: HunanDongyou Water Vapor Energy Energy-Saving CO., Ltd., Changsha (CN)

(72) Inventors: Guohe Huang, Changsha (CN); Jianlin Cheng, Changsha (CN); Ruohuang Li, Changsha (CN); Tianfei Huang, Changsha (CN); Zhongwei Li, Changsha (CN)

(73) Assignee: Hunan Dongyou Water Vapor Energy Energy-Saving CO., Ltd, Changsha (CN)

( * ) Notice: Subject to any disclaimer, the term of this patent is extended or adjusted under 35 U.S.C. 154(b) by 105 days.

(21) Appl. No.: 15/705,261

(22) Filed: Sep. 15, 2017

(65) Prior Publication Data

US 2018/0003414 A1 Jan. 4, 2018

Related U.S. Application Data

(63) Continuation of application No. PCT/CN2016/077587, filed on Mar. 28, 2016.

(51) Int. Cl.
*F24F 5/00* (2006.01)
*F25B 25/00* (2006.01)
(Continued)

(52) U.S. Cl.
CPC ..... *F25B 27/005* (2013.01); *F25B 25/005* (2013.01); *F25B 30/02* (2013.01);
(Continued)

(58) Field of Classification Search
USPC ..... 62/121, 304, 310, 314, 315, 236, 238.7; 210/175, 178, 179, 187, 263; 261/157,
(Continued)

(56) References Cited

U.S. PATENT DOCUMENTS 8,919,144 B2 * 12/2014 Liu ..... F25B 27/005 62/259.4
9,625,189 B2 * 4/2017 Tsubouchi ..... F25B 30/04
(Continued)

FOREIGN PATENT DOCUMENTS

CN 201209978 Y 3/2009
CN 201293488 Y 8/2009
(Continued)

OTHER PUBLICATIONS

Machine Translation CN 204084930U (Year: 2015).*

*Primary Examiner* — Jianying C Atkisson
*Assistant Examiner* — Gustavo A Hincapie Serna
(74) *Attorney, Agent, or Firm* — Erson IP (Nelson IP)

(57) ABSTRACT

A solar water source heat pump air conditioning system includes an air-water heat exchange system, an aqueous solution heat exchange system, a heat pump main engine, a concentration system, an energy recovery system and a condensate water recovery system. According to the present invention, solar energy in air is absorbed by utilizing the air-water heat exchange system and is provided for a heat pump. Cold-heat transfer is performed between the air-water heat exchange system and the heat pump main engine by adopting the aqueous solution heat exchange system, thereby avoiding frosting and pipeline pollution. Cold energy of air-conditioning condensate water is collected by utilizing the condensate water recovery system and then is used, thereby increasing efficiency of the heat pump main engine. Air flowing through the air-water heat exchange system is purified by adopting a haze purification system, thereby improving air quality.

5 Claims, 1 Drawing Sheet

(51) Int. Cl.
*F25B 27/00* (2006.01)
*F25B 30/02* (2006.01)
*F25D 21/14* (2006.01)

(52) U.S. Cl.
CPC ..... *F25D 21/14* (2013.01); *F24F 5/0046* (2013.01); *F24F 2005/0064* (2013.01); *F25B 2313/004* (2013.01); *F25B 2339/047* (2013.01); *F25B 2500/00* (2013.01)

(58) Field of Classification Search
USPC ..... 261/158, 159; 165/110, 112, 113, 115, 165/118
See application file for complete search history.

(56) References Cited

U.S. PATENT DOCUMENTS 9,671,143 B2 * 6/2017 Liang ..... F25B 13/00
10,138,762 B2 * 11/2018 Harada ..... F01K 7/22
2010/0192605 A1 * 8/2010 Fang ..... F24F 3/1423 62/235.1
2013/0098104 A1 * 4/2013 hman ..... B01D 5/0012 62/617
2014/0338391 A1 * 11/2014 Keisling ..... F25B 39/02 62/513
2015/0204626 A1 * 7/2015 Martell ..... F24F 1/0007 165/200
2017/0010029 A9 * 1/2017 Reytblat ..... F25B 25/005

FOREIGN PATENT DOCUMENTS

CN 201535595 U 7/2010
CN 102901167 A 1/2013
CN 203024348 U 6/2013
CN 204084930 U * 1/2015
CN 204084930 U 1/2015
CN 104676798 A 6/2015
CN 204478367 U 7/2015
JP H06317395 A 11/1994

* cited by examiner

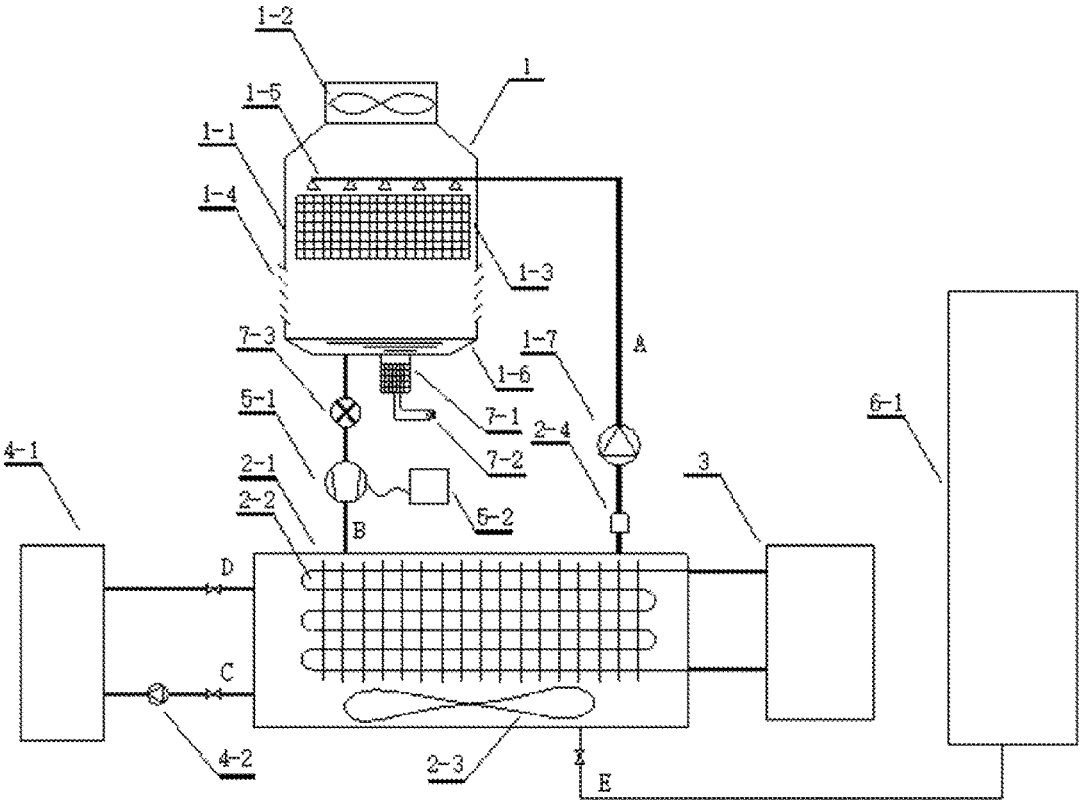
1-2
1
1-5
1-1
1-4
1-3
7-3
1-7
A
1-6
5-1
7-1
6-1
2-4
7-2
4-1
2-1
3
2-2
5-2
B
D
C
4-2
2-3
E

ALL-WEATHER SOLAR WATER SOURCE HEAT PUMP AIR CONDITIONING SYSTEM

CROSS-REFERENCE TO RELATED APPLICATIONS

This application is a continuation of International Patent Application No. PCT/CN2016/077587 with a filing date of Mar. 28, 2016, designating the United States, now pending, and further claims priority to Chinese Patent Application No. 201510115998.4 with a filing date of Mar. 17, 2015. The content of the aforementioned applications, including any intervening amendments thereto, are incorporated herein by reference.

TECHNICAL FIELD

The present invention relates to the technical field of energy conservation and utilization, also relates to an environmental protection technology for directly purifying outdoor air and filtering PM2.5 to treat haze, and particularly relates to an all-weather solar water source heat pump air conditioning system applied to an air conditioning and heating industry.

BACKGROUND OF THE PRESENT INVENTION

Air on an earth surface is influenced by solar energy, and an atmospheric temperature presents a periodical change along with a change of time. Water vapor in the air absorbs the solar energy and has a higher temperature, while liquid water on the earth surface absorbs solar thermal energy and is evaporated into gaseous water vapor, so that the air on the earth surface contains inexhaustible solar energy. At present, the solar energy can be used through many ways and methods including a solar photo-thermal method, a solar photoelectric method and the like. However, only radiation heat transfer in heat exchange is used in the utilization ways, and utilization efficiency is very low. Moreover, direct utilization of the solar energy in the air is relatively rare, and particularly approaches for absorbing the solar energy contained in the water vapor in the air are much fewer.

A novel functional mode of a heat source tower heat pump air conditioning system absorbing cold and heat sources in the air to serve as an air conditioning system by utilizing a heat source tower is applied. Due to excellent energy conservation and wide environmental suitability, the heat source tower heat pump air conditioning system has been widely applied to various architectural places in the middle and lower reaches of Yangtze River. In winter, the heat source tower serving as a good heat source collector extracts heat from low-temperature and humid ambient air to provide a heat source for a heat pump; and in summer, the heat source tower serving as a high-efficiency cooling tower discharges the heat absorbed by the heat pump from a user into an atmospheric environment. Thus, the heat source tower can be used both in winter and in summer, thereby saving initial investment and increasing an energy utilization rate.

At present, widely used heat source towers are classified into two major categories. One category is an open tower. An open heat source tower is proposed for providing the cold and heat sources for the air conditioning system in a utility model patent "heat source tower" with an application number of CN200620073647. The patent proposes that: a liquid inlet pipe is arranged on an upper part of the heat source tower; an end part of the liquid inlet pipe is connected with a sprayer; a heat exchange layer is arranged below the sprayer; a storage tank is arranged below a heat exchanger and provided with a liquid outlet pipe and a circulating pump; and an outlet of the circulating pump is connected with the liquid inlet pipe. The other category is a closed tower. A closed heat source tower is proposed to serve as a provider of the cold and heat sources of the air conditioning system in an invention patent "closed heat source tower" with an application number of CN200810031368. The invention patent proposes that: a low-temperature broadband heat exchanger composed of broadband fins and heat exchange tubes serves as a heat exchange apparatus of the heat source tower, and a negative-temperature frost prevention system composed of a solution pool, a spray pump energy storage control apparatus and the sprayer is utilized for frost prevention.

Since anti-freezing solution is always contacted with the air in an open tower system, heat exchange efficiency is higher, but a concentration of the anti-freezing solution is influenced by air humidity in the winter. In an actual operation, if the air has a low temperature and a high humidity, since the water vapor in the air is condensed into the liquid water to enter the anti-freezing solution when meeting cold air, the concentration of the anti-freezing solution is continuously decreased, and a freezing point rises, thereby increasing a hidden danger of freezing in a heat pump main engine; and if the air has a high temperature and a low humidity, moisture in the anti-freezing solution may be evaporated, and the concentration of the anti-freezing solution is increased, thereby decreasing the heat exchange efficiency of the heat pump. The concentration of the anti-freezing solution needs to be continuously adjusted in the open heat source tower system to prevent an extremely high or low concentration, so as to ensure that the system does not fail. Therefore, in order to guarantee a concentration range of the anti-freezing solution in the open heat source tower, various anti-freezing solution concentration control methods are adopted in patents, such as a utility model patent "heat source tower with solution regeneration function" with an application number of CN2011204759060, an invention patent "solution regeneration treatment apparatus" with an application number of 201210234947X, a utility model patent "waste heat utilization system for solution energy storage control apparatus" with an application number of 2012207346295, and the like. However, additional heat sources in different forms are needed in the various methods for heating the solution so as to achieve purposes of concentrating the anti-freezing solution and controlling the concentration of the anti-freezing solution, causing that economical efficiency is low and operation is complicated. Meanwhile, the anti-freezing solution in the open heat source tower is directly contacted with the air. Dust, bacteria, microbial waterweed and the like may be gathered in the anti-freezing solution to enter a heat exchange copper tube of the heat pump main engine and deposited on a tube wall, thereby greatly decreasing the heat exchange efficiency. On the other hand, although the anti-freezing solution in the closed tower is always isolated from the air, heat exchange efficiency of the closed tower is lower than that of the open system, so an area of the low-temperature broadband heat exchanger needs to be enlarged, thereby greatly increasing the initial investment.

Meanwhile, in the above air conditioning system, the heat source tower serves as the provider of the air conditioning cold and heat sources and has a low matching degree with an air conditioning main unit, so that problems of a poor heat exchange effect of the heat source tower and the air conditioning main unit, low overall efficiency of the system and the like are easily caused. In addition, in an air conditioning system used currently, condensate water of an indoor summer air conditioner of a user is generally dispersed or discharged outdoors or into a sewer line in a unified and centralized manner. Moreover, the condensate water of the air conditioner has a low temperature and is an excellent cold source of the air conditioning system. Since the condensate water cannot be utilized, waste of energy is caused.

In order to fully utilize high-efficiency heat exchange performance of the open heat source tower, avoid a defect of concentration change of the open heat source tower, ensure normal operation of the heat source tower heat pump system and increase working efficiency of the closed heat source tower heat pump system, design of a heat pump air conditioning system integrating high-efficiency heat exchange, cold energy recovery, controllable concentration, avoidance of gathering of impurities on the copper tube in the air conditioner main unit and increase of the heat exchange efficiency is inevitable.

SUMMARY OF PRESENT INVENTION

Purposes of the present invention are to overcome defects of the above open heat source tower heat pump air conditioning system and closed heat source tower heat pump air conditioning system and provide an all-weather solar water source heat pump air conditioning system capable of realizing high-efficiency outdoor open heat exchange, closed main engine cycle, cold energy recovery of condensate water, simple concentration control of anti-freezing solution and increase of solar heat utilization efficiency by means of increase of solar heat exchange manners such as a convective heat exchange manner, a conduction heat exchange manner and the like.

The purposes of the present invention are realized through the following ways:

The all-weather solar water source heat pump air conditioning system of the present invention comprises an air-water heat exchange system, an aqueous solution heat exchange system, a heat pump main engine, a concentration system, an energy recovery system, a condensate water recovery system and a haze purification system. The air-water heat exchange system is composed of an air-liquid water heat exchange apparatus, a liquid water circulating pump and a circulating pipeline. The air-liquid water heat exchange apparatus is mounted in an outdoor high position and composed of a frame body, a fan, a mixing plate, a diversion plate, a spraying pipeline and a water storage pool; an upper part of the frame body is open; the fan is mounted at the opening in the upper part of the frame body; the mixing plate is mounted at an inner part of the frame body and at a lower part of the fan; the spraying pipeline is mounted at a lower part of the fan and an upper part of the mixing plate; four sides of the frame body are open; the diversion plate is mounted on an inner side of the openings in the four sides of the frame body; and the water storage pool is mounted on a lower part of the frame body. In the circulating pipeline, the spraying pipeline is connected with an aqueous solution heat exchange box; the liquid water circulating pump is mounted on a pipeline between the spraying pipeline and the aqueous solution heat exchange box; and the water storage pool and the aqueous solution heat exchange box are connected through the circulating pipeline. The aqueous solution heat exchange system is composed of the aqueous solution heat exchange box, a micro-channel superconducting heat exchanger, a stirrer and a concentration controller. The micro-channel superconducting heat exchanger is mounted in a middle part of the aqueous solution heat exchange box; the stirrer is mounted at a bottom of the aqueous solution heat exchange box; and the concentration controller is mounted at an outlet pipeline of the aqueous solution heat exchanger. The heat pump main engine is connected with the micro-channel superconducting heat exchanger through a pipeline. The concentration system comprises a concentration water tank and a concentration circulating pump. The concentration water tank is connected with the aqueous solution heat exchange box through a pipeline. The concentration circulating pump is mounted on the pipeline. The energy recovery system comprises a turbine generator and an energy storage control apparatus. The turbine generator is mounted on a circulating pipeline between the water storage pool and the aqueous solution heat exchange box. The condensate water recovery system comprises a user condensate water pipeline system and an aqueous solution heat exchange box. The user condensate water pipeline system is connected with the aqueous solution heat exchange box through a pipeline. The haze purification system is composed of a PM2.5 haze purification particle precipitation apparatus, a precipitated particle discharging apparatus and a pipeline impurity filtering and discharging apparatus. The PM2.5 haze purification particle precipitation apparatus is mounted at a bottom of the water storage pool. The precipitated particle discharging apparatus is connected with a bottom of the PM2.5 haze purification particle precipitation apparatus through a pipeline. The pipeline impurity filtering and discharging apparatus is mounted on the circulating pipeline connected with the water storage pool.

Compared with an existing air conditioning system, the solar water source heat pump air conditioning system of the present invention has the following advantages:

1. The air-liquid water heat exchange apparatus is utilized for performing high-efficiency heat exchange, thereby increasing heat exchange efficiency;

2. The aqueous solution heat exchange box is adopted in the system, and anti-freezing solution is isolated from the heat pump main engine, thereby eliminating influences of properties of the anti-freezing solution on the main engine, avoiding corrosion and blockage problems of the anti-freezing solution on the heat pump main engine, and particularly solving problems that impurities are gathered on copper tubes in the main engine of the open heat source tower heat pump system to avoid attenuation for increasing the heat exchange efficiency;

3. The micro-channel superconducting heat exchanger is utilized for performing water-refrigerant heat exchange in the aqueous solution heat exchange box, thereby reducing a concentration requirement of the anti-freezing solution and increasing safety of the system;

4. The turbine generator is utilized for performing energy recovery;

5. Cold energy of condensate water is recovered, thereby decreasing energy consumption of the system and increasing heat pump refrigeration efficiency in summer;

6. A problem that the closed heat source tower heat pump system is high in manufacturing cost and low in heat exchange efficiency is solved;

7. Dust particles of PM2.5-PM10 in outdoor air are adsorbed by utilizing reciprocating recirculation of water while performing high-efficiency heat exchange by virtue of a gaseous water vapor-liquid water heat exchange apparatus in the air, thereby purifying the outdoor air and treating haze.

DESCRIPTION OF THE DRAWINGS

The present invention is further described below in detail in combination with drawings.

FIG. 1 is a structural schematic diagram of the present invention.

In the FIGURE, air-liquid water heat exchange apparatus (1), frame body (1-1), fan (1-2), mixing plate (1-3), diversion plate (1-4), spraying pipeline (1-5), water storage pool (1-6), liquid-water circulating pump (1-7), aqueous solution heat exchange box (2-1), micro-channel superconducting heat exchanger (2-2), stirrer (2-3), concentration controller (2-4), heat pump main engine (3), concentration water tank (4-1), concentration circulating pump (4-2), turbine generator (5-1), energy storage control apparatus (5-2), user condensate water pipeline system (6-1), PM2.5 haze purification particle precipitation apparatus (7-1), precipitated particle discharging apparatus (7-2) and pipeline impurity filtering and discharging apparatus (7-3).

DETAILED DESCRIPTION OF PREFERRED EMBODIMENTS

As shown in the FIGURE, an all-weather solar water source heat pump air conditioning system of the present invention comprises an air-water heat exchange system, an aqueous solution heat exchange system, a heat pump main engine, a concentration system, an energy recovery system, a condensate water recovery system and a haze purification system. The air-water heat exchange system is composed of an air-liquid water heat exchange apparatus (1), a liquid water circulating pump (1-7), a circulating pipeline A and a circulating pipeline B. The air-liquid water heat exchange apparatus is mounted in an outdoor high position and composed of a frame body (1-1), a fan (1-2), a mixing plate (1-3), a diversion plate (1-4), a spraying pipeline (1-5) and a water storage pool (1-6). An upper part of the frame body (1-1) is open. The fan (1-2) is mounted at the opening in the upper part of the frame body (1-1). The mixing plate (1-3) is mounted at an inner part of the frame body (1-1) and at a lower part of the fan (1-2). The spraying pipeline (1-5) is mounted at a lower part of the fan (1-2) and an upper part of the mixing plate (1-3). Four sides of the frame body (1-1) are open. The diversion plate (1-4) is mounted on an inner side of the openings in the four sides of the frame body (1-1). The water storage pool (1-6) is mounted on a lower part of the frame body (1-1). The spraying pipeline (1-5) is connected with an aqueous solution heat exchange box (2-1) through the circulating pipeline A. The liquid water circulating pump (1-7) is mounted on a pipeline between the spraying pipeline (1-5) and the aqueous solution heat exchange box (2-1). The water storage pool (1-6) and the aqueous solution heat exchange box (2-1) are connected through the circulating pipeline B. The aqueous solution heat exchange system is composed of the aqueous solution heat exchange box (2-1), a micro-channel superconducting heat exchanger (2-2), a stirrer (2-3) and a concentration controller (2-4). The micro-channel superconducting heat exchanger (2-2) is mounted in a middle part of the aqueous solution heat exchange box (2-1). The stirrer (2-3) is mounted at a bottom of the aqueous solution heat exchange box (2-1). The concentration controller (2-4) is mounted at an outlet pipeline of the aqueous solution heat exchanger (2-1). The heat pump main engine (3) is connected with the micro-channel superconducting heat exchanger (2-2) through a pipeline. The concentration system comprises a concentration water tank (4-1) and a concentration circulating pump (4-2). The concentration water tank (4-1) is connected with the aqueous solution heat exchange box (2-1) through a pipeline C and a pipeline D. The concentration circulating pump (4-2) is mounted on the pipeline C. The energy recovery system comprises a turbine generator (5-1) and an energy storage control apparatus (5-2). The turbine generator (5-1) is mounted on the circulating pipeline B between the water storage pool (1-6) and the aqueous solution heat exchange box (2-1). The condensate water recovery system comprises a user condensate water pipeline system (6-1) and an aqueous solution heat exchange box (2-1). The user condensate water pipeline system (6-1) is connected with the aqueous solution heat exchange box (2-1) through a pipeline E. The haze purification system is composed of a PM2.5 haze purification particle precipitation apparatus (7-1), a precipitated particle discharging apparatus (7-2) and a pipeline impurity filtering and discharging apparatus (7-3). The PM2.5 haze purification particle precipitation apparatus (7-1) is mounted at a bottom of the water storage pool (1-6). The precipitated particle discharging apparatus (7-2) is connected with a bottom of the PM2.5 haze purification particle precipitation apparatus (7-1) through a pipeline. The pipeline impurity filtering and discharging apparatus (7-3) is mounted on the pipeline B.

A winter workflow of the all-weather solar water source heat pump air conditioning system in the present invention is as follows:

1. The liquid water circulating pump (1-7) is started, and anti-freezing solution is extracted from the aqueous solution heat exchange box (2-1), fed to the spraying pipeline (1-5) through the circulating pipeline A, sprayed to the mixing plate (1-3) by virtue of the spraying pipeline (1-5) and then drops into the water storage pool (1-6) by virtue of gravity; the fan (1-2) is started, and air enters the frame body (1-1) from the diversion plate (1-4) and is discharged from the fan (1-2) after passing through the mixing plate (1-3). In the frame body (1-1), heat and mass transfer is performed between the air and the anti-freezing solution at the mixing plate (1-3), and heat and humidity in the air are transferred to the anti-freezing solution, thereby increasing a temperature of the anti-freezing solution and decreasing a concentration of the anti-freezing solution;

2. The anti-freezing solution flows out of the water storage pool (1-6), drops into the aqueous solution heat exchange box (2-1) through the circulating pipeline B by virtue of natural gravity and pushes a turbine to generate power while passing through the turbine generator (5-1), and the energy storage control apparatus (5-2) controls a turbine power generation state according to an operating state of the turbine generator (5-1) and then stores energy;

3. The anti-freezing solution enters the aqueous solution heat exchange box (2-1), and a flow direction and a flow state of the anti-freezing solution are changed under an action of the stirrer (2-3). While flowing through the micro-channel superconducting heat exchanger (2-2), the anti-freezing solution performs heat exchange with a refrigerant in the micro-channel superconducting heat exchanger (2-2), a temperature of the anti-freezing solution is decreased after heat is transferred to the refrigerant, and then the anti-freezing solution flows out of the aqueous solution heat exchange box (2-1) again and enters the circulating pipeline A, thereby completing a cycle of the anti-freezing solution;

4. The concentration controller (2-4) is mounted at the outlet pipeline of the aqueous solution heat exchanger (2-1), a concentration of the anti-freezing solution at the outlet of the aqueous solution heat exchanger (2-1) is sensed, and the concentration circulating pump (4-2) is started to concentrate the anti-freezing solution after the concentration of the anti-freezing solution is decreased to a certain degree;

5. The anti-freezing solution in the aqueous solution heat exchange box (2-1) is fed into the concentration water tank (4-1) by the concentration circulating pump (4-2) through the pipeline C for concentrating the anti-freezing solution, and the concentrated anti-freezing solution enters the aqueous solution heat exchange box (2-1) again through the pipeline D and is recycled;

6. A liquid low-temperature refrigerant flows through the micro-channel superconducting heat exchanger (2-2), absorbs heat of the anti-freezing solution outside the heat exchanger and is changed into a gaseous refrigerant from a liquid state to enter the heat pump main engine (3), and the gaseous refrigerant is changed into a liquid low-temperature refrigerant again to enter the micro-channel superconducting heat exchanger (2-2), thereby completing a refrigerant cycle.

A summer workflow is as follows:

1. The liquid water circulating pump (1-7) is started, and cooling water is extracted from the aqueous solution heat exchange box (2-1), fed to the spraying pipeline (1-5) through the circulating pipeline A, sprayed to the mixing plate (1-3) by virtue of the spraying pipeline (1-5) and then drops into the water storage pool (1-6) by virtue of gravity; the fan (1-2) is started, and air enters the frame body (1-1) from the diversion plate (1-4) and is discharged from the fan (1-2) after passing through the mixing plate (1-3). In the frame body (1-1), heat and mass transfer is performed between the air and the cooling water at the mixing plate (1-3), and heat in the cooling water is transferred to the air, thereby decreasing a temperature of the cooling water, evaporating the water and decreasing a water quantity;

2. The cooling water flows out of the water storage pool (1-6), drops into the aqueous solution heat exchange box (2-1) through the circulating pipeline B by virtue of natural gravity and pushes the turbine to generate power while passing through the turbine generator (5-1), and the energy storage control apparatus (5-2) controls a turbine power generation state according to an operating state of the turbine generator (5-1) and then stores energy;

3. The cooling water enters the aqueous solution heat exchange box (2-1), and a flow direction and a flow state of the cooling water are changed under an action of the stirrer (2-3). While flowing through the micro-channel superconducting heat exchanger (2-2), the cooling water performs heat exchange with a refrigerant in the micro-channel superconducting heat exchanger (2-2), a temperature of the cooling water is increased after heat of the refrigerant is absorbed, and then the cooling water flows out of the aqueous solution heat exchange box (2-1) again and enters the circulating pipeline A, thereby completing a cycle of the cooling water;

4. A gaseous high-temperature refrigerant flows through the micro-channel superconducting heat exchanger (2-2), transfers heat of the cooling water outside the heat exchanger and is changed into a liquid refrigerant from a gaseous state to enter the heat pump main engine (3), and the liquid refrigerant is changed into a gaseous low-temperature refrigerant again to enter the micro-channel superconducting heat exchanger (2-2), thereby completing a refrigerant cycle;

5. Low-temperature condensate water produced by a user of an indoor summer air conditioning system is collected together through the user condensate water pipeline system (6-1) and is connected to the aqueous solution heat exchange box (2-1) through a pipeline E. The low-temperature condensate water enters the aqueous solution heat exchange box (2-1) and then is mixed with the cooling water, a quantity of the cooling water is supplemented, and a temperature of the cooling water is decreased, thereby decreasing a condensation temperature of the refrigerant and increasing working efficiency of the heat pump main engine (3).

In year-round operation, by starting the fan (1-2), air carrying PM haze particles enters the frame body (1-1) from the diversion plate (1-4); the PM haze particles are absorbed by an aqueous solution sprayed from the spraying pipeline (1-5) to drop into the frame body (1-1), fall into the water storage pool (1-6) and then are precipitated in the PM2.5 haze purification particle precipitation apparatus (7-1); impurities in the PM haze particles are discharged and collected by the precipitated particle discharging apparatus (7-2) and the pipeline impurity filtering and discharging apparatus (7-3), thereby achieving purposes of purifying the outdoor air and treating the haze.

Valves are arranged on the pipeline C, the pipeline D and the pipeline E. The valve on the pipeline E is closed in winter and opened in summer, while the valves on the pipeline C and the pipeline D are opened in the winter and closed in the summer.

The above only describes specific embodiments of the present invention, but a protection scope of the present invention is not limited thereto. Any modification or replacement contemplated by those skilled in the art in a technical scope disclosed in the present invention without contributing creative work shall be included in the protection scope of the present invention. Therefore, the protection scope of the present invention shall be based on a protection scope defined by claims.

We claim:

1. An all-weather solar water source heat pump air conditioning system, comprising: an air-water heat exchange system, an aqueous solution heat exchange system, a heat pump main engine, a concentration system, an energy recovery system, a condensate water recovery system and a haze purification system, wherein the air-water heat exchange system is composed of an air-liquid water heat exchange apparatus (1), a liquid water circulating pump (1-7), a circulating pipeline A and a circulating pipeline 8; the air-liquid water heat exchange apparatus is mounted in an outdoor high position and composed of a frame body (1-1), a fan (1-2), a mixing plate (1-3), a diversion plate (1-4), a spraying pipeline (1-5) and a water storage pool (1-6); an upper part of the frame body (1-1) is open; the fan (1-2) is mounted at the opening in the upper part of the frame body (1-1); the mixing plate (1-3) is mounted at an inner part of the frame body (1-1) and at a lower part of the fan (1-2); the spraying pipeline (1-5) is mounted at a lower part of the fan (1-2) and an upper part of the mixing plate (1-3); four sides of the frame body (1-1) are open: the diversion plate (1-4) is mounted on an inner side of the openings in the four sides of the frame body (1-1); the water storage pool (1-8) is mounted on a lower part of the frame body (1-1); the spraying pipeline (1-5) is connected with an aqueous solution heat exchange box (2-1) through the circulating pipeline A; the liquid water circulating pump (1-7) is mounted on the pipeline A between the spraying pipeline (1-5) and the aqueous solution heat exchange box (2-1); the water storage pool (1-6) and the aqueous solution heat exchange box (2-1) are connected through the circulating pipeline B; the aqueous solution heat exchange system is composed of the aqueous solution heat exchange box (2-1), a micro-channel superconducting heat exchanger (2-2), a stirrer (2-3) and a concentration controller (2-4); the micro-channel superconducting heat exchanger (2-2) Is mounted in a middle part of the aqueous solution heat exchange box (2-1); the stirrer (2-3) is mounted at a bottom of the aqueous solution heat exchange box (2-1); the concentration controller (2-4) is mounted at an outlet pipeline of the aqueous solution heat exchanger (2-1); the heat pump main engine (3) is connected with the micro-channel superconducting heat exchanger (2-2) through a pipeline; the concentration system comprises a concentration water tank (4-1) and a concentration circulating pump (4-2); the concentration water tank (4-1) is connected with the aqueous solution heat exchange box (2-1) through a pipeline C and a pipeline D; and the concentration circulating pump (4-2) is mounted on the pipeline C; the energy recovery system comprises a turbine generator (5-1) and an energy storage control apparatus (5-2); the turbine generator (5-1) is mounted on the circulating pipeline B between the water storage pool (1-6) and the aqueous solution heat exchange box (2-1); the condensate water recovery system comprises a user condensate water pipeline system (6-1) and an aqueous solution heat exchange box (2-1); the user condensate water pipeline system (6-1) is connected with the aqueous solution heat exchange box (2-1) through a pipeline E; the haze purification system is composed of a PM2.5 haze purification particle precipitation apparatus (7-1), a precipitated particle discharging apparatus (7-2) and a pipeline impurity filtering and discharging apparatus (7-3); the PM2.5 haze purification particle precipitation apparatus (7-1) is mounted at a bottom of the water storage pool (1-6); the precipitated particle discharging apparatus (7-2) is connected with a bottom of the PM2.5 haze purification particle precipitation apparatus (7-1) through a pipeline; and the pipeline impurity filtering and discharging apparatus (7-3) is mounted on the pipeline B.

2. The all-weather solar water source heat pump air conditioning system according to claim 1, wherein the concentration controller (2-4) senses a concentration of anti-freezing solution at an outlet of the aqueous solution heat exchanger (2-1), and the concentration circulating pump (4-2) is started to concentrate the anti-freezing solution after the concentration of the anti-freezing solution is decreased to a certain degree.

3. The all-weather solar water source heat pump air conditioning system according to claim 1, wherein a heat exchange apparatus in the aqueous solution heat exchange box (2-1) is the micro-channel superconducting heat exchanger (2-2), and the stirrer (2-3) is arranged in the aqueous solution heat exchange box (2-1) for stirring the anti-freezing solution.

4. The all-weather solar water source heat pump air conditioning system according to claim 1, wherein condensate water produced by a user of a summer air conditioning system is collected by the user condensate water pipeline system (6-1) and then enters the aqueous solution heat exchange box (2-1) through a pipeline D.

5. The all-weather solar water source heat pump air conditioning system according to claim 1, wherein the PM2.5 haze purification particle precipitation apparatus (7-1) is mounted at the bottom of the water storage pool (1-6); the precipitated particle discharging apparatus (7-2) is connected with the bottom of the PM2.5 haze purification particle precipitation apparatus (7-1) through the pipeline; and the pipeline impurity filtering and discharging apparatus (7-3) is mounted on the pipeline B.

* * * * *